United States Patent [19]

Ing et al.

[11] 4,088,485

[45] May 9, 1978

[54] GRADED BANDGAP XEROGRAPHIC PLATE

[75] Inventors: Samuel Wei Ing, Webster; Fred William Schmidlin, Pittsford, both of N.Y.

[73] Assignee: Xerox Corporation, Stamford, Conn.

[21] Appl. No.: 624,361

[22] Filed: Oct. 21, 1975

Related U.S. Application Data

[63] Continuation of Ser. No. 422,931, Dec. 7, 1973, abandoned.

[51] Int. Cl.[2] ..... G03G 5/082

[52] U.S. Cl. ..... 96/1.5 R; 252/501; 338/15

[58] Field of Search ..... 96/1.5, 1.8; 252/501; 313/94; 338/15

[56] References Cited

U.S. PATENT DOCUMENTS

| | | | |
|---|---|---|---|
| 3,350,595 | 10/1967 | Kramer | 96/1.5 X |
| 3,647,427 | 3/1972 | Hanada et al. | 252/501 X |
| 3,696,262 | 10/1972 | Antypas | 313/94 |
| 3,708,291 | 1/1973 | Kinoshita et al. | 96/1.5 |
| 3,795,513 | 3/1974 | Ciuffini | 96/1.5 X |
| 3,816,787 | 6/1974 | Shimizu et al. | 313/94 |
| 3,861,913 | 1/1975 | Chiou | 96/1.5 |
| 3,894,870 | 7/1975 | Kinoshita et al. | 96/1.5 |
| 3,904,408 | 9/1975 | Hanada et al. | 96/1.5 |

*Primary Examiner*—Roland E. Martin, Jr.
*Attorney, Agent, or Firm*—J. J. Ralabate; J. P. O'Sullivan; John E. Crowe

[57] ABSTRACT

A xerographic plate and photoreceptor having improved speed and image resolution capability comprising a charge generating photoconductor layer, a trapping layer and a profile layer interposed between the trapping and charge generating layers; a suitable profile layer being obtained for xerographic purposes by utilizing materials from the charge generating and trapping layers having different band gaps but applied so as to obtain a gradation or gradient rather than a sharp interface.

23 Claims, No Drawings

GRADED BANDGAP XEROGRAPHIC PLATE

This is a continuation of application Ser. No. 422,931, filed Dec. 7, 1973, now abandoned.

BACKGROUND OF THE INVENTION

In the electrophotographic or xerographic art it is customary to utilize photoreceptor plates having at least an external photoconductive insulating layer and a charge conductive supporting substrate. Generally, a photoconductive layer is uniformly electrostatically charged in the absence of light or other activating radiation and, thereafter, exposed to a light pattern which can correspond to a negative image. The areas of the photoconductive layer which are so exposed selectively lose their charge much more rapidly than non-exposed areas. As a result, the photoconductive layer at least temporarily retains a charge corresponding essentially to a latent positive image. This image can then be conveniently developed to form a visible positive image by contacting with oppositely charged pigmented particles commonly identified as toner particles which will adhere mostly to the charged areas. The resulting image may optionally be permanently affixed to the photoconductor if the imaging layer is not to be reused. This usually occurs with binder-type photoconductive film where the photoconductive imaging layer is also an integral part of the finished copy.

Where "plain paper" copying systems are involved, however, the latent image is conveniently developed on the imaging surface of a reusable photoconductor, or transferred to another surface such as a sheet of paper, and thereafter developed. After a latent image is developed on the imaging surface of a reusable-type photoconductor, it is transferred to another substrate and then permanently affixed by using any one of a variety of well-known techniques such as by overcoating with a transparent film, or by thermal fusion of the toner particles to the sheet. In such a copying system the materials in the photoconductive layer must be capable of rapidly changing from an insulative, to a charge-conductive, and then back to an insulative condition to permit cyclic use of the imaging surface. Failure to revert back to the insulative state before each succeeding charging sequence will result in a high dark decay rate commonly referred to as "fatigue". In the past, the problem has been controlled, to some extent, simply by selection of those photoconductive materials having the best known rapid switching capacity. Typical of such materials are anthracene, poly(N-vinylcarbazole), sulfur, selenium, selenium alloys, metal-free phthalocyanines, etc., and mixtures thereof (U.S. Pat. No. 2,297,691).

While organic photoconductive materials such as poly(N-vinylcarbazole) generally have good dark decay characteristics, they tend to lack sufficient inherent photosensitivity to be completely competitive with selenium. For this reason, they are usually used together with "activators". Poly(vinylcarbazoles), for example, are sensitized with 2,4,7-trinitro-9-fluorenone to obtain improved photoresponse, discharge characteristics (ref. U.S. Pat. No. 3,484,237). There are also other organic resins which are traditionally considered non-photoconductive, but which can be sensitized with Lewis Acids to form charge-transfer complexes which are photoresponsive at the visible end of the spectrum. U.S. Pat. Nos. 3,408,181; 3,408,182; 3,408,183; 3,408,184; 3,408,185; 3,408,186; 3,408,187; 3,408,188; 3,408,189; and 3,408,190 are of interest in this area.

For all practical purposes, the amount of sensitization of both photoconductive and non-photoconductive resins depends upon the concentration of the activator; within limits, the higher the loading, the greater the photoresponse obtained. Unfortunately, however, loadings exceeding about 10 weight percent of the photoconductive composition will usually tend to impair mechanical and/or other photoconductive properties of the sensitized composition. Excessive amounts of activator in either a photoconductive or a nonphotoconductive material of the type disclosed in the above patents will tend to crystallize out of the photoconductive composition.

The above inherent limitations make it very difficult and often times impossible to obtain the much-desired marriage of a high quantum efficiency photoconductor with a tough, transparent, active matrix material having a low injection threshold.

One very useful discovery directed to the above goal utilizes various types of protective polymeric overcoats capable of holding a charge of high field strength on an external surface while also permitting selective transmittal of holes (i.e. charge transfer) from the photoconductive or generating layer to obtain an electrostatic image.

While the last mentioned system offers many substantial advantages, there still remains the need for further improvement, particularly in the area of image resolution and speed, without causing a corresponding increase in the rate of dark discharge.

It is believed that xerographic plates having improved speed and resolution can be obtained if the plates are made of a juxtaposed layer of two materials, one material facilitating photogeneration while the other facilitates charge transport. Except for the situation in which photogeneration is effected from impurity centers, greater sensitivity (speed) is correlated with narrowed band gaps. Unfortunately, however, a reduction in band gap generally also results in substantially greater thermal generation and corresponding faster rate of dark decay.

OBJECTS OF THE INVENTION

It is an object of the present invention to obtain and utilize a new class of xerographic plates utilizing elements having improved physical and electrical properties to permit a wider and more flexible use of xerographic principles for copying purposes.

It is a still further object to obtain improved speed, sensitivity and image resolution without corresponding loss in dark decay characteristics.

SUMMARY OF THE INVENTION

It has been found that the above objects can be obtained by utilizing a xerographic element comprising:

A. a substrate;

B. an intermediate element having at least
  - a charge generating layer,
  - a charge transport layer, and
  - an intermediate profile layer containing material from both adjacent layers in gradient concentrations,
  - the intermediate element being arranged in indicated or in inverse order such that the charge generating layer or the charge transport material of said intermediate element is adjacent to the substrate; and C. an outside element comprising
a profile layer, and
a trapping layer,
said outside element being optional when arranged adjacent and external to the charge generating layer of said intermediate element, the profile layer of said outside element, when present, containing
1. trapping material and
2. either
a. charge transport material or
b. charge generating material in gradient concentrations coinciding with the adjacent layer of said intermediate element.

For purposes of the present invention, it is found that the best results are obtained when there is substantially no sharp interface between the components of profile layers of the intermediate or outside elements as above described, and particularly between transport material and charge generating material.

For purposes of the present invention, it is further found that excellent speed, sensitivity and image resolution are obtained by using a photoconductor device having a carrier trapping layer which is compatible with the charge transport layer. In particular, a charge generating material having a band gap of about 0.3–1.9 electron volts and a corresponding trapping or transport layer material having a higher band gap, in each instance, of no less than about 1.6 electron volts.

Of particular interest as photogeneration materials for purposes of the present invention, are those having band gaps between 1.3 and 1.8 ev., because they are capable of utilizing the full visible spectrum for charge generation purposes. As a rule, the narrower the band gap the thinner the photogeneration layer, because of inherent difficulty in avoiding thermal generation centers in the narrower band gap materials. For this same reason, the most promising materials for the trapping layer have band gaps larger than 1.7 ev. Appropriate materials for the trapping layer depend on whether the image is formed with minority carriers or with majority carriers on the side opposite to the exposed surface. If the image is formed with minority carriers, then the photogeneration material may even contain sufficient traps (ref. Diagram B less the outside element). If the image is formed with majority carriers on the opposite surface, then a wider band gap material may be required. Although materials with band gap in the 1.5 ev. range cannot be completely ruled out as trapping materials, the chances of being able to incorporate the required concentration of deep traps are best when the band gap exceeds about 2.0 ev.

Generally speaking, photogeneration and transport are prime considerations insofar as "speed" is concerned. The important consideration with regard to image resolution, however, involves the permanent trapping of carriers in the image-forming region (i.e. where the charge contrast forms). If the concentration of deep traps in the image forming region is too low, lateral conduction will cause a loss in image resolution. Such a limitation on resolution is not problematic. Either the image is formed with minority carriers (for which deep traps are normally more prevalent), or the image is formed in the surface region where more traps also naturally occur. An important situation in which natural surface traps are inadequate, occurs when the image is formed on a surface opposite to the exposed surface, and the photoconductor is of a one carrier type.

If the image-forming region has too few traps to maintain the required surface resistance, then one possible remedy is to coat the photoconductor with a high resistivity layer. An equivalent way of accomplishing this is to dope the image-forming region with additional deep traps. However, this requires exact knowledge of the presence and amount of impurities. Moreover, the chances of finding appropriate impurities for sensitive photoconductors is small (i.e. those with relatively narrow band gaps). It has been found best, therefore, to coat the photoconductor with a wider band gap material.

Theoretically, when a two-layer coated plate is employed, a substantial interfacial energy barrier can form at the junction of the two coats. Such a barrier will effectively prevent realization of the desired benefits if the band gap differential is too great, since charge carriers are prevented from crossing the interface.

It has been determined that the effect of such a barrier layer can be mitigated for xerographic purposes by making the change in energy gradual in going, for instance, from the photogeneration to a carrier layer. This is possible, for instance, when two materials are sufficiently compatible to form a concentration gradient or profile of both trapping material and charge transport material. Compounds which form alloys possess a continuously varying energy gap as a function of the compositions and a useful graded barrier can be formed which is permeable to a sufficient carrier concentration.

In any case, an essential requirement of a transport layer for purposes of this invention is that it have a schubweg ($\mu\tau E$) greater than the layer thickness. Since a total plate thickness of a few tens of microns is typically required for most dry development processes, a $\mu\tau$ value greater than $10^{-7}$ cm$^2$/v is needed. Using the formula $\tau = (N_t\sigma)^{-1}$ where N is defined as the trap center density and $\sigma$ as the cross section, and assuming that $\mu \sim 10$ cm$^2$/v-sec is representative of an amorphous material, it is found that less than $10^{13}$ cm$^{-3}$ "coulombic" trapping centers having a binding energy greater than 0.8 ev, and $10^{16}$ cm$^{-3}$ "geometrical" trapping centers having a binding energy greater than 0.65 ev. are typical. Material selection, therefore, is determined mainly by the ease with which coulombic centers in the 0.8 to 1.1 ev range can be avoided.

From the discussion above, it follows that the chance of achieving a good homogeneous plate is best with trapping materials falling in the 1.6 to 1.8 ev. range. To make available a greater variety of materials for plates or elements thereof with improved and varied characteristics, it is found desirable to exploit multilayers. To avoid barrier complications in multilayered plates however, it is best to use materials which form alloys of a continuously variable composition.

The above-described invention is more explicitly exemplified in the following diagram:

DIAGRAM A

| |
|---|
| Layer (1) |
| Layer (2) |
| Layer (3) |
| Layer (4) |
| Layer (5) |
| Layer (6) |
| (Light) |

wherein

Layer 6 represents a light-permeable substrate having a charge conductive surface such as a NESA glass or an ultra-thin metal film of suitable conductivity;

Layer 5 represents at least one applied photoconductive charge-generating layer comprising material which is capable of photogenerating, or photogenerating and transporting charges into contiguous layers; for this purpose, the photoconductive layer is preferably in the form of a homogeneous amorphous selenium based photoconductor such as $As_2Se_3$, or others listed in Col. A of Table I below, or as a material represented by the general formula $Se_xAs_yTe_z$, or as $Se_xAs_ySb_z$ in which $x$ is defined as 75–90, $y$ as 1–5 and $z$ as 10–20. Such materials are usefully in the form of a homogeneous layer of sufficient thickness to absorb the impinging light. Generally speaking, however, a thickness of about 0.1–10$\mu$ is found adequate and 0.1–1$\mu$ is preferred for this purpose;

Layer 4 represents an adjacent profile or gradient layer containing, for instance, about 100–0%:0–100% concentration of (a) charge generating material (ref. Col. A, Table I) and (b) charge transport material. This layer is conveniently about 0.5–5$\mu$ or greater in thickness; and preferably about 0.5–2$\mu$;

Layer 3 represents a long range charge transport layer of known type as demonstrated, for instance, by Se, Se+S, CdS, $CdSeAs_2Se_3$ and $AsS_3$ + $AsSe_3$. This layer can be about 10–50$\mu$ in thickness and is preferably about 10–30$\mu$;

Layer 2 represents a second profile layer containing about 100–0%:0–100% concentration of charge transport material of known types (ref. Layer 3 and Table I) and trapping material (ref. Col. A, Table I). This layer can usefully vary from about 0.5–5$\mu$ or greater in thickness, and preferably about 0.5–2$\mu$;

Layer 1 represents an undifferentiated layer of about 100% concentration of trapping material exemplified by one or more compounds listed in Col. B of Table I. Such material consistently has a higher band gap than the charge transport material of layer 3 and usefully varies from about 0.05–1$\mu$ in thickness.

Generally speaking, there is no obvious interface between layers 1-2 or 4-5 as diagrammed, and a total coating thickness of about 10–60$\mu$ is found satisfactory for xerographic purposes, although this invention is not limited to this range.

Table I illustrates useful combinations of components for forming profile layers in accordance with the present invention.

TABLE I

| A | | | B | |
|---|---|---|---|---|
| $As_2Se_3$ | (1.7)* | ⇄ | $As_2S_3$ | (2.5)* |
| $Sb_2S_3$ | (1.7) | ⇄ | $As_2S_3$ | (2.5) |
| $Sb_2S_3$ | (1.7) | ⇄ | $Sb_2O_3$ | (4.2) |
| $Bi_2S_3$ | (1.3) | ⇄ | $Bi_2O_3$ | (3.2) |
| CdSe | (1.7) | ⇄ | CdS | (2.4) |
| CdSe | (1.7) | ⇄ | ZnSe | (2.6) |
| CdTe | (1.5) | ⇄ | ZnTe | (2.1) |
| HgSe | (.6) | ⇄ | HgS | (2.0) |
| $Ga_2Se_3$ | (1.9) | ⇄ | $Al_2Se_3$ | (3.1) |
| $Ga_2Se_3$ | (1.9) | ⇄ | $Ga_2S_3$ | (2.5) |
| $In_2Se_3$ | (1.2) | ⇄ | $In_2S_3$ | (2.0) |
| $Ga_2Te_3$ | (1.2) | ⇄ | $Al_2Te_3$ | (2.5) |
| $In_2Se_3$ | (1.2) | ⇄ | $Ga_2Se_3$ | (1.9) |
| $Ga_2Te_3$ | (1.2) | ⇄ | $Ga_2Se_3$ | (1.9) |
| InP | (1.25) | ⇄ | GaP | (2.24) |
| GaAs | (1.4) | ⇄ | GaP | (2.24) |
| GaAs | (1.4) | ⇄ | GaAs | (2.4) |
| AlSb | (1.5) | ⇄ | AlSb | (2.4) |

TABLE I-continued

| A | | | B | |
|---|---|---|---|---|
| Te | (.34) | ⇄ | Se | (2.1) |

*band gaps are indicated in parenthesis

A second embodiment of the described invention is diagrammatically represented in Diagram B below:

DIAGRAM B

| |
|---|
| (Light) |
| Layer (1) |
| Layer (7) |
| Layer (5) |
| Layer (4) |
| Layer (3) |
| Layer (6) |

wherein

Layers 1, and 3–6 are essentially defined as in Diagram A, and Layer 7 is conveniently a profile layer containing trapping material and charge generating material with the above-indicated band gap limitations. Layers 1 and 7, however, are optional embodiments of Diagram B in view of the fact that corotron-induced charges in natural surface traps can have a substantial effect on lateral charge migration in the surface of the element.

Generally speaking, layers 3–5 in Diagram B have no clear interface and can total about 10–60$\mu$ while layers 1 and 7 can total about 0.5–5$\mu$ in thickness.

In the above-described elements, a charge is preferably formed on a top surface by corotron charging with subsequent light exposure such that the traps can hold this pattern for a desired time period.

A still further modification of the present invention utilizes a substrate and applied charge transporting matrix material having dispersed therein up to about 10% by weight of specially treated fines of a charge generating particles of relatively low band gap such as listed in Col. A. of Table I; this material usefully has an outer condensed profile or gradient shell of about 0.2–2$\mu$ in thickness and the system corresponds to layers 3–6 of Diagram A supra.

Profile layers of the type represented by layers 4 and 2 of Diagram A and layers 4 and 8 of Diagram B are conveniently obtained by general vacuum deposition techniques similar to those used to apply selenium photoconductive layers onto substrates (ref. U.S. Pat. Nos. 2,803,542; 2,901,348 and 2,753,278).

It is useful for purposes of the present invention, however, to modify conventional photoconductor vacuum evaporation techniques to the extent of providing a plurality of individually heated and shuttered steel crucibles to maintain evaporation rates sufficient to assure control over the amount of charge generating material (ex. $As_2Se_3$), trapping material (ex. $As_2S_3$) and transport materials (ex. Se, $AsS_3$ + $AsSe_3$) available for evaporation and condensation onto a substrate. A preferred technique for obtaining such layers involves heating a plurality of covered crucibles to about 300°–420° C. and then selectively opening the covers in timed sequence to assure starvation of one component at the beginning and starvation of the other component at the conclusion of the coating process. Where the charge generation and trapping occurs in a plurality of particles later to be incorporated into or admixed with suitable charge transporting matrix material, however, a profile layer can alternatively be applied on the particles by a further modified evaporation-condensation technique. For example, relatively cool inorganic photoconductive fines can be agitated and/or circulated, in a partial vacuum, in convenient proximity to heated steel crucibles containing suitable charge-generating and/or transport trapping materials in the manner indicated above. For the later purpose, a 0.1–0.9$\mu$ thickness of profile layer will suffice.

Insofar as the present invention is concurred, it is not intended to restrict the type of organic or inorganic materials employed as a charge transport layer provided the above-indicated criteria can be satisfied.

The following examples are intended to further illustrate various preferred embodiments of the instant invention.

EXAMPLE I

Two NESA test plates identified as T-1 and T-2 are placed in a vacuum coater above and proximate to three identical shuttered stainless steel crucibles (identified as A-C) equipped with individual resistance heating means and containing respectively (a) 10 gm. $As_2Se_3$; (b) 5 gm. $As_2Se_3$ + 5 gm. $As_2S_3$; and (c) 10 gm. $As_2S_3$. The coater is then evacuated to $5 \times 10^{-4}$ Torr and the three crucibles heated to about 350° C. and exposed in sequential overlapping order for 10, 30 and 4 minute periods, respectively, with overlapping exposure such that crucible "A" is open to evaporation for 7 minutes before opening crucible "B", and "B" is open for 28 minutes before "C" is opened. The resulting coating NESA test plates contain an upper $As_2S_3$ film of about 0.1$\mu$ thickness and an overall substrate coating of about 13$\mu$. Both plates are then removed and dip coated in a bath consisting of a 20% isooctane solution of "Piccopale H-2" and an equal volume of "Dow 276 V-2"[1] and air dried to obtain a thin deformable thermoplastic overcoat layer of about 1$\mu$ which is responsive to a charge pattern when softened or exposed to solvent. The plate is charged to +800 V on the side opposite the substrate, exposed imagewise through the substrate, heated to about 80° C. for 5 minutes and the image resolution on the trapping layer side is evaluated by observing differences in diffraction pattern distortion caused by the latent image charge on the trapping layer side. This procedure is generally in accordance with U.S. Pat. No. 3,542,545 and an article by Gundlach and Claus in "Photographic Science and Engineering" Vol. 7, No. 1, pages 14–19 (January–March 1963). The results are reported in Table II below.

[1] Penna. Industrial Chemical Corp. (1973) and Dow Chemical Corp. (1973).

EXAMPLE II (Control)

A NESA control test plate identified as C-1 is mounted in a vacuum coater as in Example I near three shuttered stainless steel crucibles (i.e. D, E and F) which are identical to the crucibles of Example I and contain respectively 10 gm. $As_2Se_3$, 10 gm. $As_2S_3$ + $As_2Se_3$, and 10 gm. of $As_2S_3$. The coater is evacuated to $5 \times 10^{-4}$ Torr, and crucible D heated to 350° C., opened for 10 minutes and then covered. The procedure is next repeated with crucible E for 30 minutes and then for crucible F for 4 minutes with no overlap permitted; the coater and crucibles are then permitted to return to ambient condition. The resulting plate contains a 0.1$\mu$ layer of $As_2S_3$ and an overall substrate coating of about 13 $\mu$ layer containing separate charge transport and trapping layers. The plate is then coated as in Example I with a 0.3 $\mu$ thermoplastic film and tested for image resolution as in Example I (ref. Table II).

TABLE II

| Sample | Image Resolution * |
|---|---|
| T-1 | ex |
| T-2 | vg |
| C-1 | p |

* ex = excellent
vg = very good
g = good
f = fair
p = poor

EXAMPLE III

Two test strips identified as T-3 and T-4 are prepared by placing aluminum foil in a vacuum coater, above and proximate to two identical shuttered stainless steel crucibles identified respectively as "G" and "H" containing respectively (a) 7.5 gm. $AsSe_3$ and (b) 9 gm. $As_2Se_3$ + 3 gm. $As_3S_3$. The evaporation-condensation step is then effected by heating the closed crucibles to 350° C., opening crucible "H" for 40 minutes, crucible G being opened after 30 minutes have passed and then the temperature slowly raised to 400° C. for the 10 additional minutes after the shutter on crucible H is closed. The resulting test strips have an average total coating of about 14$\mu$, including an upper $As_2Se_3$ photoconductive charge generating layer of about 1$\mu$ thickness. The strip is tested** and the test results reported in Table III below:

EXAMPLE IV (Control)

A test control strip identified as C-2 is prepared by placing an aluminum foil strip in a vacuum coater containing three identical shuttered stainless stell crucibles each of which contains 9 gm. of $As_2Se_3$ and 3 gm. of $As_2S_3$. The crucibles and then heated to 350° C. and opened for 15 minutes, the temperature raised to 400° C. for an additional 15 minutes and the coater allowed to return to ambient temperature and pressure. The resulting coated test strip contains a 14$\mu$ film of $As_2Se_3$ + $As_2S_3$ over the aluminum substrate. This control strip is then test** and the results reported in Table III below.

TABLE III

| Test Sample | Field (v/$\mu$) Average | Photo Discharge Rate Average (v/sec.) |
|---|---|---|
| T 3–4 (Av) | 6.8 | 47.0 |
| (Ex. III) | 10 | 64.0 |
| | 15 | 78.0 |
| | 20 | 90.0 |
| C-2 | 6.8 | 13.0 |
| (Ex. IV) | 10 | 19.0 |
| | 15 | 36.0 |
| | 20 | 54.0 |

** Evaluation tests run at 5,000 A
$F = 5 \times 10^{11}$ cm$^{-2}$/sec$^{-1}$
+ charge

What is claimed is:

1. A xerographic element comprising:

(a) a substrate;

(b) an intermediate element comprising:

a charge generating layer, a charge transport layer, and an intermediate profile layer containing material from both adjacent layers in gradient concentrations, the intermediate element being arranged in indicated or inverse order such that the charge generating layer or the charge transport material is adjacent to the substrate; and (c) an outside element comprising:

a profile layer, and a trapping layer the profile layer of said outside element containing:

(1) trapping material, and (2) (a) charge transport material or (b) charge generating material in gradient concentrations coinciding with the adjacent layer of said intermediate element, said generating material in each instance having a bandgap of about 0.3–1.9 electron volts and the corresponding trapping or transport layer material having a higher bandgap, in each instance, of no less than about 1.6 electron volts.

2. A xerographic element of claim 1 wherein there is substantially no sharp interface between trapping material and charge generating material.

3. The xerographic element of claim 1 wherein charge generating material has a band gap of about 0.3–1.9 electron volts and trapping material has a higher band gap in each instance, of no less than about 1.6 electron volts.

4. A xerographic element of claim 1 wherein the profile layer of the intermediate element is individually or collectively applied onto a layer comprising a plurality of charge generating particles of relatively low band gap dispersed in a charge transporting matrix material.

5. An xerographic element of claim 1 wherein the substrate is light permeable; the photoconductive charge generating layer of the intermediate element comprises material selected from the group consisting of $AsSe_3$, $SbS_3$, $Bi_2S_3$, CdSe, CdTe, HgSe, $Ga_2Se_3$, $In_2Se_3$, $Ga_2Te_3$, InP, GaAs, AlSb, material represented by the formula $Se_xAs_yTe_z$ and the formula $Se_xAs_ySb_z$, wherein $x$ is defined as 75–90; $y$ as 1–5 and $z$ as 10–20; and the trapping layer of the outside element comprises material consisting of $As_2S_3$, $Sb_2O_3$, $Bi_2O_3$, CdS, AnSe, AnTe, HgS, $Al_2Se_3$, $Ga_2S_3$, $In_2S_3$, $Al_2Te_3$, $Ga_2Se_3$, GaP, GaAs, AlSb, and Se.

6. A xerographic element of claim 1 wherein the charge generating layer of said intermediate element is an externally arranged layer containing at least one photoconductive charge generating material selected from the group consisting of $AsSe_3$, $SbS_3$, $Bi_2S_3$, CdSe, CdTe, HgSe, $Ga_2Se_3$, $In_2Se_3$, $Ga_2Te_3$, InP, GaAs, AlSb, material of the formula $Se_xAs_yTe_z$, and material of the formula $Se_xAs_ySb_z$, wherein $x$ is defined as 75–90, $y$ as 1–5, and $z$ as 10–20; and a charge transport layer adjacent to the substrate.

7. The xerographic element of claim 5 wherein the outside element includes a 0.05–1$\mu$ layer of trapping material.

8. The xerographic element of claim 5 wherein the profile layer of the outside element is 0.05–5$\mu$ or greater.

9. The xerographic element of claim 1 having an outside element comprising a trapping layer and a profile layer.

10. A xerographic element of claim 9 wherein the trapping layer consists essentially of $As_2S_3$ and the charge generating material of the intermediate element consists essentially of $As_2Se_3$.

11. A xerographic element of claim 9 wherein the trapping layer consists essentially of $As_2S_3$ and the charge generating layer of the intermediate element consists essentially of $Sb_2S_3$.

12. A xerographic element of claim 9 wherein the trapping layer consists essentially of $Sb_2O_3$ and the charge generating layer of the intermediate element consists essentially of $Sb_2S_3$.

13. A xerographic element of claim 9 wherein the trapping layer consists essentially of CdS and the charge generating layer of the intermediate element consists essentially of CdSe.

14. A xerographic element of claim 9 wherein the trapping layer consists essentially of Se and the charge generating layer of the intermediate element consists essentially of Te.

15. A xerographic element of claim 6 wherein the charge generating material of the intermediate element consists essentially of $As_2Se_3$.

16. A xerographic element of claim 6 wherein the charge generating material of the intermediate element consists essentially of $Sb_2S_3$.

17. A xerographic element of claim 6 wherein the charge generating material of the intermediate element consists essentially of CdSe.

18. A xerographic element of claim 6 wherein the charge generating material of the intermediate element consists essentially of Te.

19. A xerographic plate utilizing the element of claim 7 wherein the trapping material of the outside element consists essentially of $As_2S_3$ and the charge generating material of the intermediate element consists essentially of $As_2Se_2$.

20. A xerographic plate utilizing the element of claim 7 wherein the trapping material of the outside element consists essentially of $As_2S_3$ and the charge generating material of the intermediate element consists essentially of $Sb_2S_3$.

21. A xerographic plate utilizing the element of claim 7 wherein the trapping material of the outside element consists essentially of $Sb_2O_3$ and the charge generating material of the intermediate element consists essentially of $Sb_2S_3$.

22. A xerographic plate utilizing the element of claim 7 wherein the trapping material of the outside element consists essentially of CdS and the charge generating material of the intermediate element consists essentially of CdSe.

23. A xerographic plate utilizing the element of claim 7 wherein the trapping material of the outside element consists essentially of Se and the charge generating material of the intermediate element consists essentially of Te.

* * * * *